United States Patent [19]

Coad

[11] Patent Number: 4,491,095

[45] Date of Patent: Jan. 1, 1985

[54] CYCLIC DWELL ENGINE

[75] Inventor: George L. Coad, Lafayette, Calif.

[73] Assignee: Avalon Research, Oakland, Calif.

[21] Appl. No.: 515,390

[22] Filed: Jul. 20, 1983

[51] Int. Cl.[3] ..... F02B 71/04; F15B 15/26

[52] U.S. Cl. ..... 123/46 R; 123/48 B; 123/18 R

[58] Field of Search ..... 123/46 R, 46 A, 46 B, 123/48 R, 48 B, 78 R, 78 B, 78 BA, 78 E, 18 R

[56] References Cited

U.S. PATENT DOCUMENTS

| | | | |
|---|---|---|---|
| 2,978,986 | 4/1961 | Carder et al. | 60/595 |
| 3,575,087 | 4/1971 | Sherwood | 92/23 |
| 3,908,379 | 9/1975 | Fitzgerald | 60/595 |
| 4,205,638 | 6/1980 | Vlacancinch | 123/46 A |
| 4,308,720 | 1/1982 | Brandstadter | 123/46 R |

*Primary Examiner*—Craig R. Feinberg

*Assistant Examiner*—David A. Okonsky

*Attorney, Agent, or Firm*—George W. Wasson

[57] ABSTRACT

The invention disclosed herein is a cyclic power mechanism including means providing for a variable dwell between cycles of the mechanism. The mechanism produces energy during each cycle and stores the energy of each cycle for consumption. The variable dwell between cycles is terminated and a new cycle is initiated upon the consumption of a preestablished portion of the stored energy. A preferred embodiment of the mechanism is a free piston engine operation on an Otto cycle. The piston of the engine is restrained after each combustion cycle as the energy of that combustion is stored for use. When a preestablished portion of the stored energy has been consumed, the piston is released and forced into another compression and combustion cycle for further storage of the combustion energy.

14 Claims, 10 Drawing Figures

CYCLIC DWELL ENGINE

This invention relates to an internal combustion engine and the use of that engine as the energy source for driving an energy demand system. More particularly this invention relates to as engine which operates only when energy is demanded within the energy demand system. Further, the invention relates to cyclic power mechanisms and more particularly to cyclic combustion engines for automotive application.

BACKGROUND OF THE INVENTION

Conventional engine for propelling automobiles are typically the spark ignition type and, to a lesser extent, the compression ignition diesel type. Both types demonstrate a less than optimum fuel economy at varying road loads. Since automotive use is rarely at optimum load, economy is compromised. Free piston engines have shown superior indicated thermal efficiency; however, the methods of power conversion yield poor efficiency and no overall advantage.

The internal combustion engine of the present invention is a free piston engine operating on a Otto cycle with autoignition. Free piston engines are well known including engines employing opposed pistons operating within a cylinder. The pistons are driven initally toward each other in the cylinder to compress an injected fuel charge to the condition of autoignition. The resulting combustion forces the pistons away from each other. Energy is extracted from the moving piston for external use and the pistons are driven back toward each other by a bounce action within the cylinders [sometimes pneumatic spring driven and sometimes hydraulic spring driven]. In the known prior art free piston engines, the pistons continue to oscillate within the cylinder without dwell.

The free piston engine of the present invention differs in one major aspect from the prior art by including a brake system to provide a controlled dwell between cycles of the piston whereby the engine is controlled to cycle or "pulse" only when the energy from the prior pulse has been used by the energy demand system. The pulse rate of the engine varies directly with load. The combustion conditions are constant regardless of pulse rate and are optimized for maximum fuel economy. Furthermore, in the system herein disclosed of an engine and an energy demand system, the energy storage system is quite small since only cyclic pulse energy is stored. The free piston engine and energy demand system thus have a high power to weight ratio.

SUMMARY OF THE INVENTION

The most pertinent prior art to which the present invention relates is U.S. Pat. No. 2,978,986 for Free Piston Engine, issued Apr. 11, 1961 to F. B. Carder et al. That patent discloses a free piston engine having a continuously oscillating piston. The present invention uses a similar engine with the addition of a means to provide a controlled dwell between cycles of the piston. In the modification of a conventional free piston engine as proposed herein, the nature of the free piston engine changes to provide constant and favorable combustion conditions at all loads. This change produces a number of advantages including: low specific fuel consumption, a flat fuel consumption-load curve, low weight, high torque, a flat torque-speed curve, a simple construction, and a possibility for modular construction.

It is therefore an object of the present invention to provide a free piston engine wherein the piston or pistons are operated only when energy from previous energy input has been consumed, the foregoing being accomplished by stopping the piston when energy is no longer needed and releasing the piston for operation when energy is demanded.

A further object of the invention is a brake system for operation on the piston of a free piston engine to stop the piston at the time that the piston is at zero velocity after combustion.

Another object of the invention is a method for operating a free piston engine, in accord with the preceding objects, which will cause the engine to operate only when energy is demanded while permitting a cyclic dwell between energy demands.

Other objects and features of the invention will be readily apparent to those skilled in the art from the appended drawings and specification illustrating a preferred embodiment wherein:

DESCRIPTION OF THE PREFERRED EMBODIMENT

Figure 1:
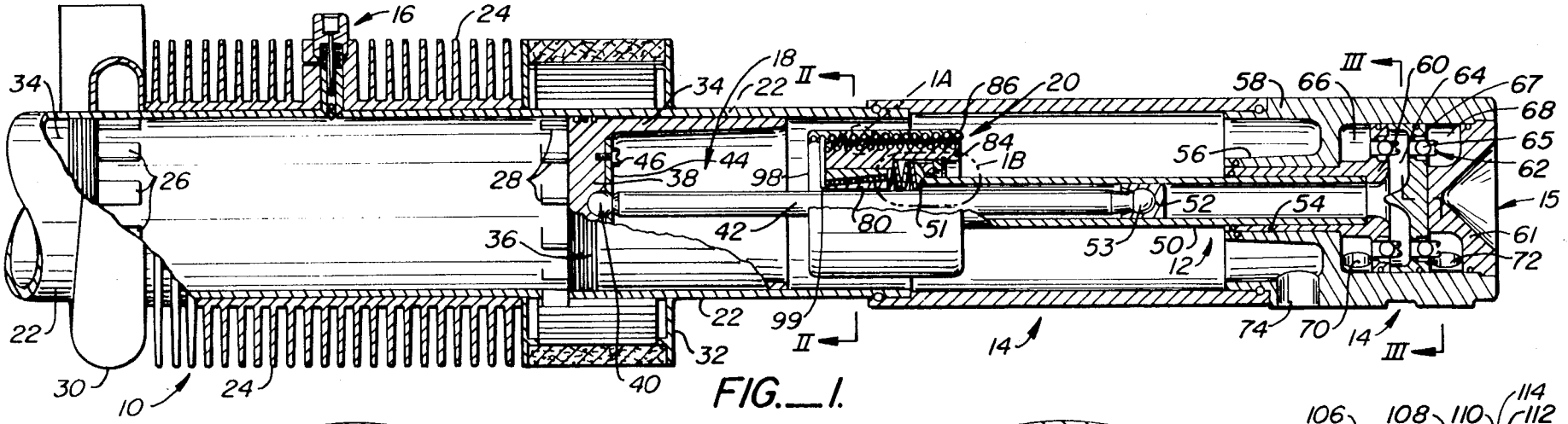
FIG. 1 is an elevational view, including partial sectional views of the elements of the free piston engine of the present invention.

FIG. 1 illustrates the free piston engine of the present invention in partial section. Only one half of the preferred design for the engine is illustrated, it should be understood that the portion illustrated is duplicated to the left of the fuel injection assembly [to be more fully identified hereinafter].

The elements of the engine include a cylinder assembly 10, a pump assembly 12, a cylinder extension 14, a fuel injector assembly 16, a piston assembly 18, and a brake assembly 20. With the exception of the fuel injector assembly, each assembly is duplicated on each side of the two piston engine shown herein.

CYLINDER ASSEMBLY

The cylinder assembly 10 consists of cylinder tubes 22 establishing the right and left side engine cylinders with a central fin portion 24 for heat dissipation. The interior of the cylinder tubes 22 are formed with exhaust ports 26 at one side and intake ports 28 at the other side. The exterior of the cylinder tubes 22 are adapted with an exhaust scroll 30 at one side cooperating with the exhaust ports 26 and an intake flange 32 at the other side cooperating with the intake ports 28. In the engine illustrated the exhaust and intake are at the left and right, respectively; however, it should be understood that those locations are merely a design preference.

The fuel injector assembly 16 is positioned at the center of the engine cylinder assembly. While a substantially conventional fuel injector for a diesel engine could be used, the fuel injector here employed is designed to supply fuel under pressure to the interior of the combustion chamber portion of the engine cylinder assembly only during the compression stroke. The fuel injector will be described hereinafter.

The engine includes a pump assembly 12 at each end of the engine. The cylinder assembly 10 and pump assembly 12 are connected by the cylinder extension 14 for establishing an internal operating space for other engine elements to be further described hereinafter.

The piston assembly 18 is positioned within the cylinder assembly 10 with one piston at each side of the engine. The piston assembly 18 includes a piston 34 having a conventional external ring set 36 which may include the three rings positioned in groves around the cylinder 32. The piston has a hollow interior adapted at its interior head end 38 for accomodating the formed ball end 40 of a push rod 42. A split retainer plate assembly 44 encircles the ball end 40; the retainer is fixed to the interior head end 38 of the piston 34 by suitable connectors 46.

PUMP ASSEMBLY

The pump assembly 12 includes a pump cylinder 50, enclosing a pump piston 52 mounted on the ball end 53 of push rod 42. The pump cylinder 50 is coaxially aligned with the cylinder tubes 22 and is adapted, at the end away from the combustion chamber of the engine, with a valve assembly 15 for cooperation with the interior of the pump cylinder. The pump cylinder 50 is supported within an extension 54 of a valve assembly 15 which is supported on an interior portion 56 of a valve body 58. The valve body 58 is suitably fixed to the interior of the cylinder extension 14. The valve assembly 15 further includes an intake valve assembly 60 comprising a plurality of spring loaded check valves and an outlet valve assembly 62 comprising a second set of spring loaded check valves, both to be more fully described with reference to FIG. 3. The two valve sets communicate with an annular outlet manifold 64 which communicates directly with the pump piston head end of the pump cylinder 50. The intake valve assembly 60 controls pump fluid flow from annular inlet manifold 66. The outlet valve assembly 62 controls pump fluid flow from annular pump chamber 68. The exterior of the valve assembly 15 is adapted with twin ports 70 cooperating with the annular inlet manifold 66 and twin ports 72 cooperating with the pump chamber 68. Another port 74 is provided in the exterior of the pump assembly to communicate with the interior of the cylinder extension 14 for a purpose to be defined hereinafter.

BRAKE ASSEMBLY

The brake assembly 20 is mounted at the interior of the engine between the piston assembly 18 and the valve assembly 15 and on the piston end of the pump cylinder 50. The brake assembly 20 is adapted to grasp the push rod at a time when it is at zero velocity in a manner to be described hereinafter.

Figure 2:
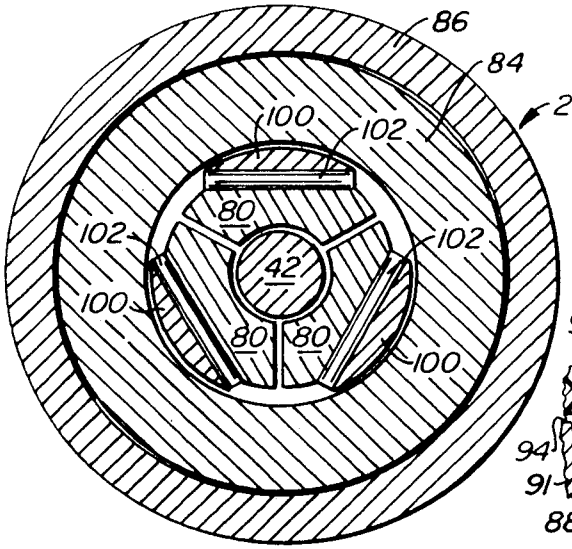
FIG. 2 is a sectional view taken along the lines of II—II of FIG. 1.

The brake assembly 20 comprises a three jawed collet supported by needle bearings on tapered ways. The brake is deactivated by a solenoid having a short stroke and high force. As shown in FIGS. 1 and 2, the collet jaws 80 are designed such that their inner surfaces cooperate with the outer surfaces of the push rod 42. In deactivated position, the jaws are spaced slightly from the push rod allowing the rod to reciprocate freely as the piston assembly 18 reciprocates. When activated as a brake, the collet jaws clamp against the outer surface of the push rod 42 and prevent it and the piston assembly from reciprocating. Activation and deactivation is caused by two conditions of energization of the solenoid.

The solenoid comprises inner and outer cylinder members 84 and 86, respectively. The outside surface of the inner cylinder 84 is turned with a double helix high pitch thread 88 and the inside surface of the outer cylinder 86 is similarly turned at 90. The root of the alternate threads of each cylinder is occupied by bifilar windings 91 and 92 and the turned threads are then filled with a suitable potting material 93. The threading of these opposing surfaces establishes thread crests 94 in the inner cylinder 84 and thread crests 96 in the outer cylinder 86. The adjacent crests can create magnetic poles of a solenoid when the windings 91 and 92 are carrying electrical current. When so energized the alternate poles of the inner and outer cylinders act as a number of individual solenoids in magnetic series thus providing a high total force acting through a short stroke.

Bifilar windings as employed in this invention are multiple or single conductors in adjacent thread roots of each cylinder carrying current in opposite direction but from the same energization. The windings could be established by folding a single conductor in half and placing one conductor from each half in adjacent thread roots. Because the threads are a double helix, the folded conductor would then establish adjacent conductors which may be energized with current in opposite polarity from a single source.

The outer cylinder 86 is threaded onto the inner cylinder in a manner to position the alternate poles within the beginnings of the thread cuts in the opposite cylinders. At the left end of the outer cylinder, as viewed in FIG. 1, a disk like collar 98 is fixed to the inner surface of the cylinder. The inner diametrical surface of the collar 98 has an extension 99 which bears against the left end of the collet jaws 80 to transmit motion to the collet jaws when the solenoid is energized.

The inside surface of the inner cylinder 84 has a plurality of bearing insert members 100 fixed to it in a manner to be radially aligned with the collet jaw members 80. A plurality of needle bearings 102 are positioned between the inner surface of the bearing inserts and the outer surface of the collet jaws, these surfaces being machined to establish a flat surface in their transverse and longitudinal direction and each being tapered, in opposite slopes, in their longitudinal direction. Since only very slight movement of the needle bearings is needed, the needle bearings may be held between the bearing inserts and the collet jaws with a flexible potting material. The material holding the bearings in place is not shown.

Leftwardly force on pushrod 42 from piston 52 is restrained by wedging action of collet jaws 80. Movement of the collet jaws 80 in a rightwardly direction, as viewed in FIG. 1, allows radially outward movement to disengage the collet jaws 80 from contact with the push rod 42 thus releasing the braking action.

The entire brake assembly 20 is supported on the free end of pump cylinder 50 about a collar 51 which may be formed by swaging the end thereof. The assembly of the threaded inner cylinder 84 and outer cylinder 86 with bearing inserts 100, bearings 102, and collet jaws 80 are positioned over the collar 51 with a bounce spring 104 acting against the collar at one end and against an inner shoulder 106 in the inner cylinder 84. A collet spring 81 is positioned between the bounce spring 104 and the collet jaws 80. The bounce spring 104 biases the brake assembly in a leftward direction and the collet spring 81 biases the collet jaws 80 toward the left into a braking engagement with the push rod 42. The inner end of the bounce spring 104 is in position to be engaged by the inside of the pump piston 52 to assure symmetry of function of the two pistons as will be more fully described hereinafter.

The brake assembly is held on the pump cylinder 50 by a circular angular slip collar 108, a circular radial slip collar 110, and a retaining ring 112. The retaining ring 112 fits into an inner slot 114 in the inside surface of inner cylinder 84 to hold the brake assembly in place. The angular slip collar has a an arcuate, concave machined surface cooperating with a mating arcuate, convex surface on the outer surface of the collar 51 of pump cylinder 50 to insure parallel alignment of the brake assembly on the pump cylinder 50.

The brake assembly is deactivated when electrical current with proper polarity is supplied to the appropriate pair of bifilar windings 91 and 92 of the inner and outer cylinders 84 and 86. When deactivated the push rod 42 may run freely in both directions within the engine assembly. If the polarity of current to the windings in either the inner or the outer brake cylinder is reversed causing a reversal of magnetic polarity at thread crests of that cylinder, the solenoid action of the brake assembly causes the collar 98 to move and causes extension 99 to move the collet jaws 80 permitting them to engage or release the push rod 42 so that the brake assembly can function as a linear reverse locking brake. With proper electrical control, as will be described with reference to FIG. 7, the brake assembly is caused to engage the push rod and thus restrain the piston assembly after a combustion cycle. The brake assembly engages the push rod and performs the detaining function at a time of approximately zero velocity movement of the push rod. The braking action creates substantially large radial forces on the brake body when the brake detains the piston because of the interaction at the needle bearings between tapered surfaces of the collet jaws 80 and the bearing inserts.

Similarily a substantially large force is required to release the brake. Such a force is developed by the multiple threads acting as a number of individual solenoids in magnetic series. The total effect of this solenoid design is to provide a high force at the expense of shortened stroke as is needed to release the brake.

VALVING ASSEMBLY

Figure 3:
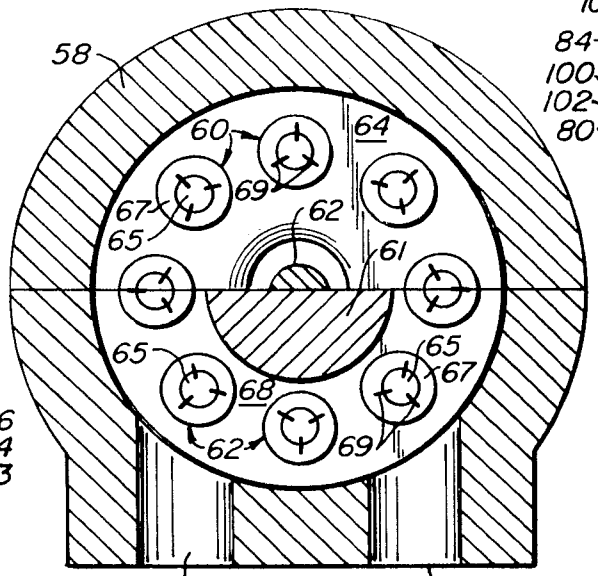
FIG. 3 is a sectional view taken along the lines of III—III of FIG. 1.
Figure 1A:
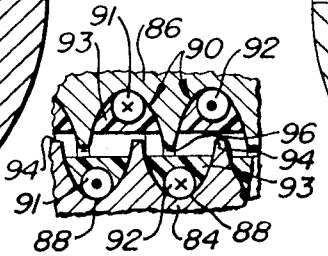
FIG. 1A is a partial sectional view of the portion of FIG. 1 encircled and identified by the label 1A.

FIG. 3 illustrates a cross-section along lines III—III of FIG. 1 through the valving assembly 15 illustrating the placement of the spring biased intake valve assembly 60 and outlet valve assembly 62. The valve assemblies are held in place within the engine by an end plate 61. Both valve assemblies comprise a number, here shown as eight, of small ball check valves having balls 65 mating with valve seats 67 with the balls being retained within the assembly by spring keepers 69. Inlet valve assembly 60 allows fluid to flow through port 70 into, but not out of, the pump cylinder 50 and outlet valve assembly 62 allows fluid to flow from pump cylinder 50 out, but not in, through port 72. The plurality of individual ball check valves in both input and output assembly allows for high volume fluid flow without incurring severe hydraulic losses. A plurality of check valves is used in each assembly to reduce the mass of the individual valves and thereby reduce the response time of the valve assemblies. The arrangement of the valve assemblies within the pump body creates annular inlet and outlet manifolds 64 and 66 and provides for convenient manifold interfacing.

With the design and configuration herein shown the valves may accomodate the action of the high pump speed. The flow of fluids out of the pump cylinder 50 issues radially to a realm of lower velocity, passing through the outlet check valves 62 with reasonable pressure drop and then outwardly through ports 72. The multiplicity of valves in each assembly and the close coupling to the pulsing columns of the pump assembly minimizes hydraulic losses.

The foregoing description of the elements of the engine of the present invention has been directed to only one side of a two sided opposed piston engine. While one piston within a cylinder would operate successfuly, it is preferred to use the opposed piston design because of balance and synchronization. It should be understood that, except for the fuel injection system, the elements described are duplicated at each side.

MOTOR VEHICLE INSTALLATION

Figure 4:
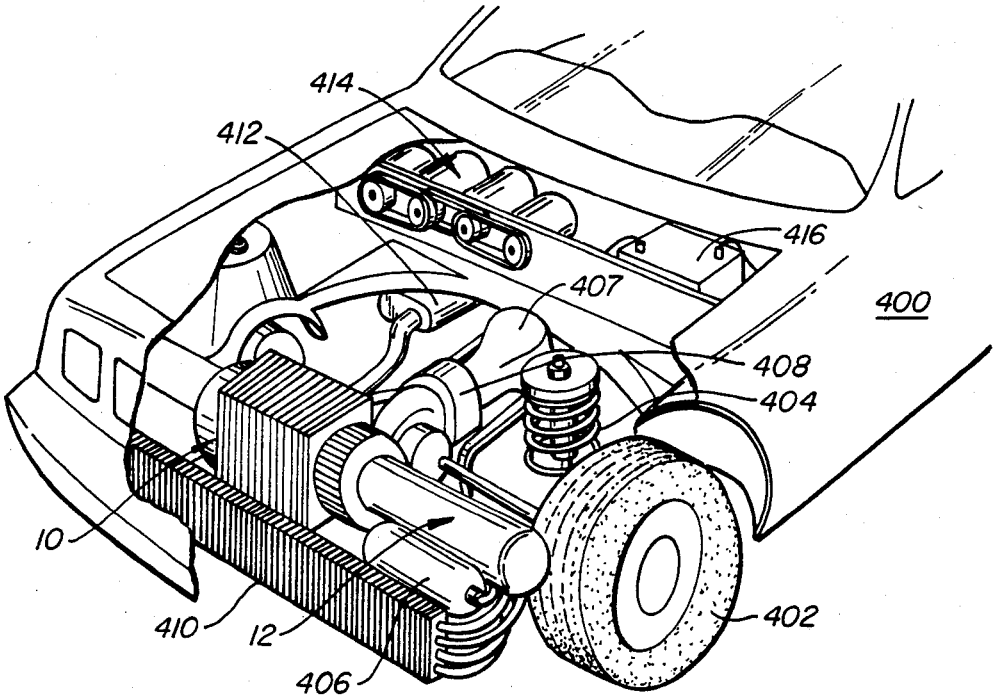
FIG. 4 is a perspective view, partially in section, illustrating the cyclic dwell engine and energy demand system of the present invention as part of a conventional motor vehicle.

FIG. 4 is a perspective view, partially in section, illustrating the cyclic dwell engine of the present invention as a part of a conventional motor vehicle. The standard automotive components of a conventional motor vehicle may include a body 400 with the usual frame members or a unibody assembly, a set of front wheels 402 (only one shown), and a suspension system 404. In the vehicle here illustrated, the cylinder assembly 10 is mounted transversly of the body and frame. The engine supplies power output from the pump assembly to a plurality of hydraulic accumulators 406 (only one being shown in this figure), whose purpose will be more fully described hereinafter, and through the accumulators to a fluid motor 407. The fluid motor supplies drive power to the wheels 402 through a transaxle 408. An oil cooler 410 for the hydraulic fluids from the pump 12 and to the fluid motor 407 is mounted in front of the piston assembly 10 and accumulators 406. Other conventional motor vehicle related elements illustrated in FIG. 4 include a muffler 412 for exhaust gasses; mechanical accessories 414 such as power steering, power brakes, air conditioning, a charging pump, start motor-generator accessory fluid motor and turbovacuum pump and others; and a conventional storage battery 416.

FIG. 4 is intended only as an illustration of a possible engine mounting in a conventional motor vehicle showing only the relative size and probable placement of elements. The design illustrated is based on calculations demonstrating that the engine and drive system designed in accordance with the present invention can be so mounted on a conventional motor vehicle and can supply more than adequate power to drive the vehicle.

HYDRAULIC SYSTEM

Figure 5:
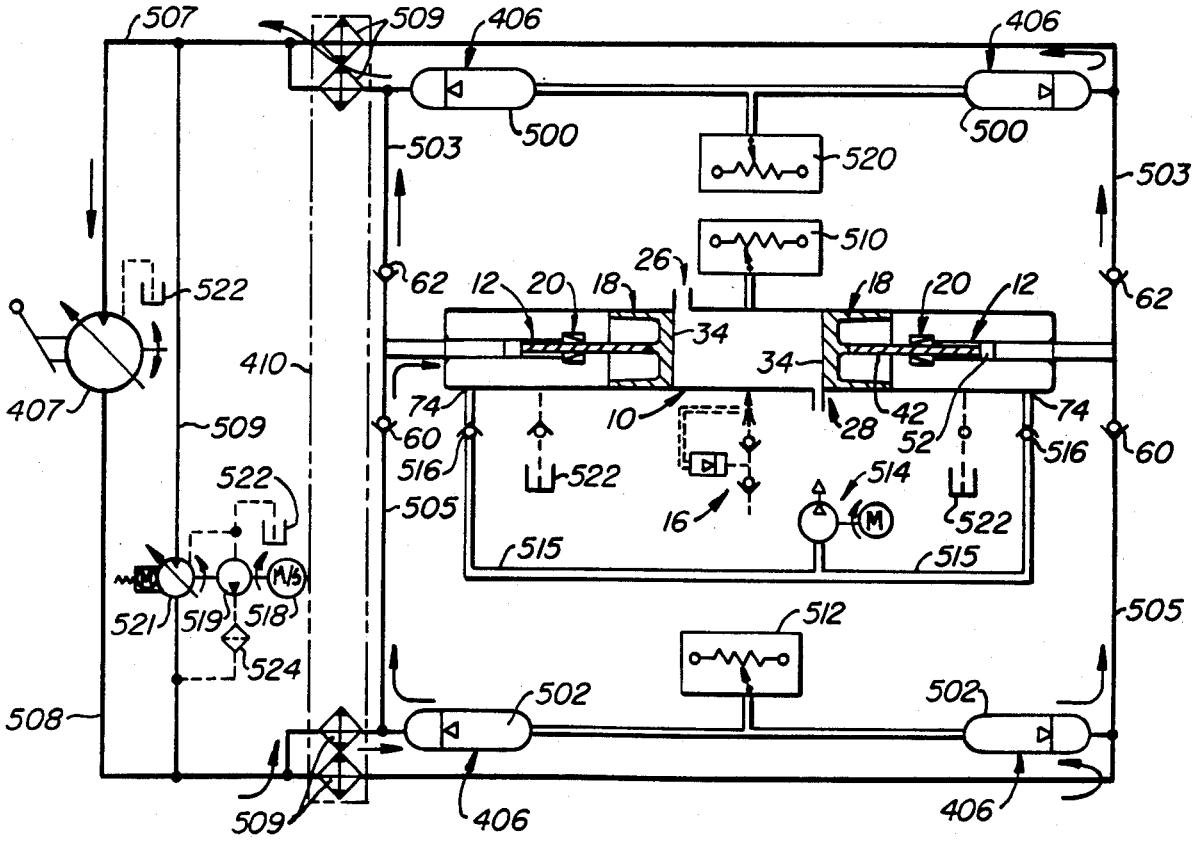
FIG. 5 is a schematic illustration of the hydraulic system of the present invention.

FIG. 5 is a schematic illustration of the hydraulic system of the present invention. The cylinder assembly 10 is illustrated as having two opposed piston assemblies 18, two pump assemblies 12, and two brake assemblies 20; details of the valving assemblies 15 are not shown. As described with reference to FIG. 1, the engine includes an air intake port 28, an exhaust port 26, a fuel injection assembly 20, pistons 34, push rod 42, and pump piston 52. The hydraulic system includes the four accumulators 406, two of which are high pressure accumulators 500 and two of which are low pressure accumulators 502. The high pressure accumulators 500 are connected by tubing 503 and check valves 62 to the output port of the pump assembly 12 and the low pressure accumulators 502 are connected by tubing 505 and check valves 60 to the input port of the pump assembly. The high pressure accumulators 500 supply fluid pressure to the fluid motor 407 through tubing 507, and tubing 508 connects the fluid motor to the low pressure accumulators 502. High pressure fluid is also supplied through tubing 509 to a fluid motor system for driving the mechanical accessories as will be described hereinafter. Fluid flow out of the high pressure accumulators 500 and into the low pressure accumulators flows through the oil cooler 410 which includes schematically illustrated heat exchangers 509.

The accumulators 500 and 502 include a fluid pressure side and a gas pressure side seperated by a diaphragm. The fluid system side of the hydraulic system is essentially incompressible. The gas system is thus compressed to the pressure established on the fluid system to maintain the fluid under pressure. The fluid is then useable as the drive fluid to drive motor 407 from high pressure accumulator 500 and to the systems driven by the low pressure accumulators 502 as will be described hereafter.

Figure 6:
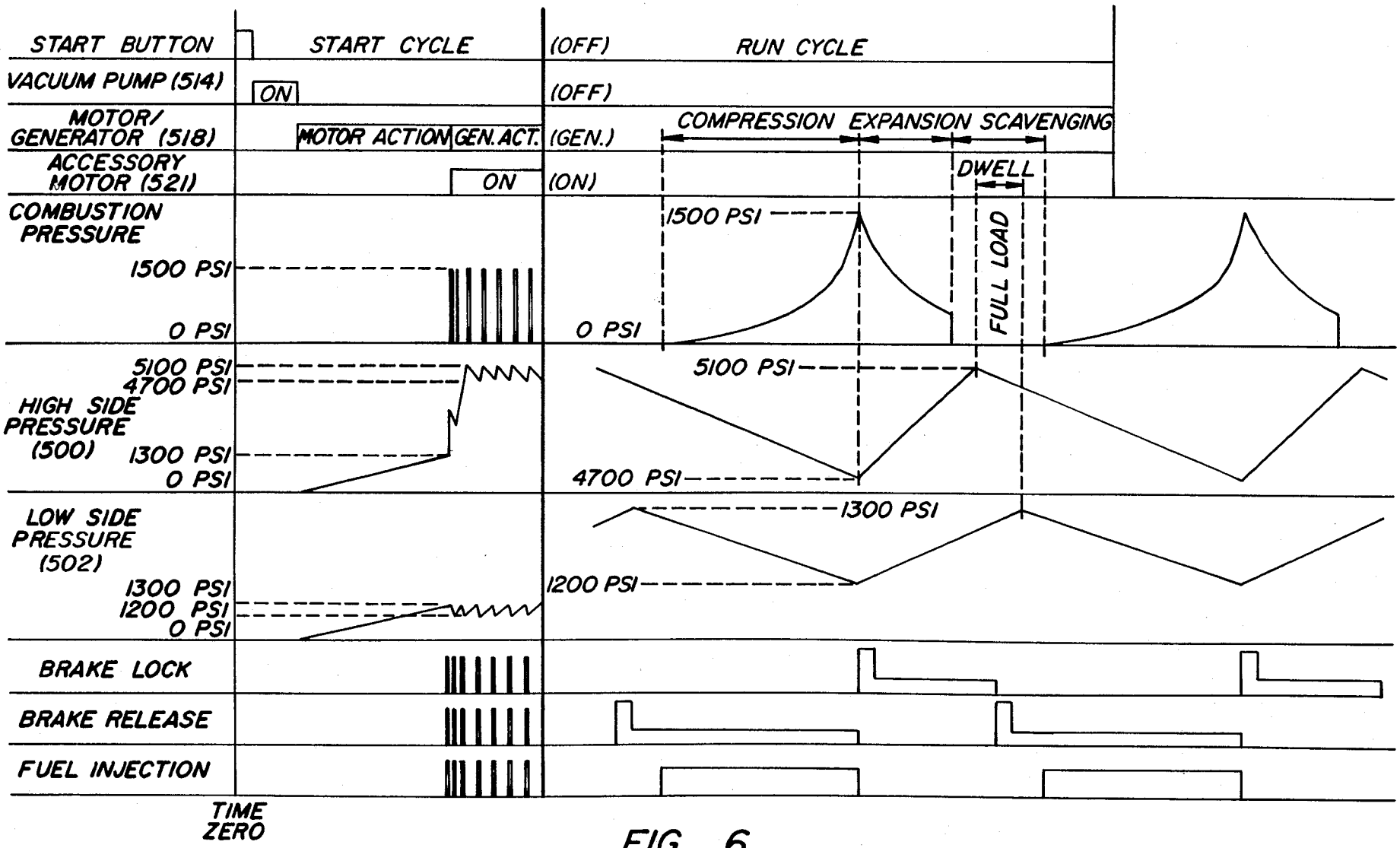
FIG. 6 is a timing diagram for the engine and system of the present invention.

For ease in understanding the hydraulic power diagram of FIG. 5 and the electronic control diagram of FIG. 6 it will be helpful to consider the operating mode of the free piston engine of the present invention. After a combustion portion of an engine cycle, the piston 34 is driven outwardly to drive hydraulic fluid in pump cylinders 52 into the high pressure accumulators 500 through outlet valve assembly 62. The detonation of combustion has been sensed by transducer 510 to actuate the brake assembly 20 to permit the push rod 42 to move outwardly but not inwardly. The piston assembly is thus braked at substantially zero velocity at the end of the expansion stroke.

High pressure fluid from accumulators 500 is supplied to the drive motor 407 on demand and that fluid flows through to the low pressure accumulators 502. A transducer 512 senses the pressure in low pressure accumulator 502 and supplies control signals to the brake assembly 20 to permit release of the brake at the desired predetermined pressure. Brake release is controlled to occur when the pressure in the high pressure accumulator 500 has fallen to a level requiring an increase and when the pressure in low pressure accumulator 502 has risen to a sufficient pressure to drive the pistons 34 into another compression cycle. The hydraulic pressure from the low pressure accumulator 502 is supplied through intake check valve assembly 60 to the pump piston 52 to drive push rod 42 and piston 34 into the cylinder assembly 10. During the compression cycle a fuel charge is injected by the fuel injection assembly 16 and at high compression autoignition occurs and the pistons are forced outwardly again to pump high pressure fluid from pump assembly 12 into the high pressure accumulators 500. The detonation again is detected by transducer 510 and the brake assemblies 20 are again actuated to restrain the piston push rod 42 at the end of the expansion stroke.

Considering now the start mode of the engine; prior to starting the piston 34 may be at rest at any point in the possible stroke within the cylinder assembly 10; the hydraulic pressure throughout the entire system (both high and low pressure) is at atmospheric pressure; the gas pressure within the accumulators is at some pressure less than operational level depending on leakage within the system, ambient temperature, and engine downtime. When a start cycle has been initiated, the turbovacuum pump 514 draws a vacuum on lines 515 through check valve 516 and port 74 to evacuate the chambers behind the pistons 34. In a short period of time the pistons 34 are drawn to their fullest extension which is further than normal operating extension. Brake assemblies 20 are energized to be operational to hold the push rods 42 in the extended position. Limit switches, not shown in FIG. 5, are then actuated to turn off the turbovacuum pump and to initiate the remaining sequence of starting.

A motor-generator assembly 518 which functions as a motor to drive a charging pump 519 or be driven by an accessory fluid motor 512 is set as a motor by the start switch actuation to drive the pump 519 to supply pumped fluids to the high and low pressure accumulators 500 and 502 to build the low pressure to operating level. When the pressure within low pressure transducer has been built to operating pressure, transducer 512 responds to release the cyclic dwell brake assemblies 20 and a first compression cycle is initiated under the hydraulic pressure from the low pressure accumulator 502.

The first thermodynamic cycle is very similar to a normal operating cycle except the stroke is 80% longer. Thus the compression ratio is considerably higher than normal. After a few strokes the cycle settles down to the normal operating stroke. The first expansion stroke meets with considerably less resistance than a typical operational expansions stroke because the high side pressure is about one fourth of normal. Therefore a considerable amount of the first stroke energy goes into compressing the high side system hydraulic fluid from 1300 psi to 4900 psi, resulting in an extraordinarily long stroke. The second stroke is close to normal, having a somewhat higher compression ratio but a more normal expansion stroke. By the third or fourth stroke stability is achieved and pulse rate becomes a function of load.

The pressure in the high pressure transducer 500 is sensed by trandsducer 520 to control the motor/generator 518 and accessory motor 521 during the start up cycles. When the pressure in the hydraulic system is above the low pressure requirements but not yet to full high pressure requirements, the motor action of motor/-generator 518 is no longer needed and the unit can be switched to function as a generator. During starting the accessory motor 521 is controlled to be effectively "OFF". When the high pressure has been built high enough, the accessory motor is then turned "ON" to permit it to drive charging pump 519 and the mechanical accessories system 414.

Leakage sumps 522 are shown at the engine cylinder 10, the fluid motor 407, the charging pump 519 and the accessory motor 521. These sumps collect leakage hydraulic fluid from the engine and the motors and supply the fluid to charging pump 519. The fluid is resupplied to the hydraulic system through a filter as needed.

START AND RUN TIMING CYCLES

For a further understanding of the starting and running cycles of the cyclic dwell engine, reference should be had to FIG. 6. This figure illustrates, on the left side, a start cycle with a series of run cycles, and, on the right side, an expanded representation of a run cycle. The time scale (horizontally along the bottom of the figure) is compressed for the start cycle and expanded for the run cycle, and, in the run cycle, the pressure scale (vertical scale) is expanded. As previously described, before initiating the first compression cycle, it is desirable to withdraw the pistons to substantially full withdrawn position. Starting at time zero in a start cycle, at closing of a start switch or button, the vacuum pump 514 (FIG. 5) is energized to draw the pistons to their withdrawn position and the motor/generator 518 (FIG. 5) is energized as a motor to drive the pump 519 to build up hydraulic pressure in high and low pressure accumulators 500 and 502, respectively. When the low pressure transducer 512 senses a desired pressure in low pressure accumulator, here shown as 1300 psi, a brake release signal is supplied, and the pressure in the low pressure accumulators drives the pistons toward each other in a compression cycle, and fuel is injected into the cylinder ahead of the piston at the appropriate time.

When combustion has occured, the detonation transducer 510 senses the build up of detonation pressure and energizes the cyclic dwell brake jaws to prepare them to grasp the push rods 42 at the end of their outward travel.

After the first combustion cycle it is unlikely that the high pressure accumulator 500 has reached its desired pressure therefore a second combustion cycle in initiated. These cycles continue until the desired high pressure has been accumulated and so long as the pressure in low pressure accumulator 502 is at the brake release pressure.

The series of "run" cycles following the first few "start" cycles shown in the left side of FIG. 6 represents repeating cycles as might occur with full load demand from the high pressure accumulators. The right side of FIG. 6 illustrates, in expanded time and pressure scales, the timing of actions that take place during a run cycle. During the run cycle, the start switch is OFF, the vacuum pump is OFF, the motor/generator is being driven as a generator by the accessory motor which is ON. The combustion pressure portion of the figure illustrates the pressure within the cylinder during compression as the piston is driven from the low pressure accumulator, the pressure builds from 0 psi to about 1500 psi. During that interval fuel is injected into the cylinder by the fuel injector assembly 16. It should be noted by reference to the bottom illustrated graph display that the fuel injection assembly is energized only during compression with fuel injection ending at or just before detonation. During expansion after combustion occurs, the pressure within the cylinder decreases toward 0 psi when the scavangeng ports in the cylinder are opened. During the dwell between compression strokes the cylinder pressure is blown down to 0 psi or at a slight vacuum when the momentum of flow from blow down through the exhaust system creates a vacuum in the combustion chamber. As the expansion stroke is completed, the intake ports of the engine are opened and the vacuum draws in a fresh charge of air.

It should be understood that the dwell cycle shown in FIG. 6 represents a full load cycle and is quite short. At lesser loads, the draw down of high pressure fluids and build up of low pressure fluids will be much longer and the subsequent compression cycle will begin at some greater delayed time. The engine pulse rate may vary from a few to as many as 2000 pulses per minute dependent upon load conditions.

The High Side Pressure graph of FIG. 6 illustrates the variation in high pressure within the high pressure accumulators between a maximum of about 5100 psi and a low of about 4700 psi. The build up to 5100 psi and drop off to 4700 psi may not be linear as illustrated, the rate of change in these pressures is dependent upon the hydraulic pump action and the load draw. The graph is intended to illustrate the possible variation with a full load condition.

The Low Side Pressure graph of FIG. 6 illustrates the representative variations between 1300 psi and 1200 psi. During the compression cycle the low pressure and high pressure accumulators will reduce pressure as the piston is driven into compression and as the output motor draws hydraulic pressure. The low pressure will increase as expansion due to combustion occurs, based on the draw of hydraulic fluid by the output motor, until a new compression cycle is initiated.

The brake lock and brake release graphs of FIG. 6 illustrate the timing for brake actuation and brake release. As combustion is detected by the detonation transducer the brake actuating coil is energized to set the brake to restrain the push rod 42 from moving toward compression after it has driven pump piston 52 to its fullest compression position. After the initial brake actuation pulse is applied to set the brake for braking, the brake is then energized (as will be described) to maintain the engine piston in dwell position. When pressure builds up in the low pressure accumulator 502 to the pressure set to initiate a compression cycle, the brake is supplied with a release pulse, to release the brake, followed by holding energization, to maintain the brake released during compression, until detonation occurs to cause reenergization of the brake for braking.

ELECTRONIC CONTROL

Figure 7:
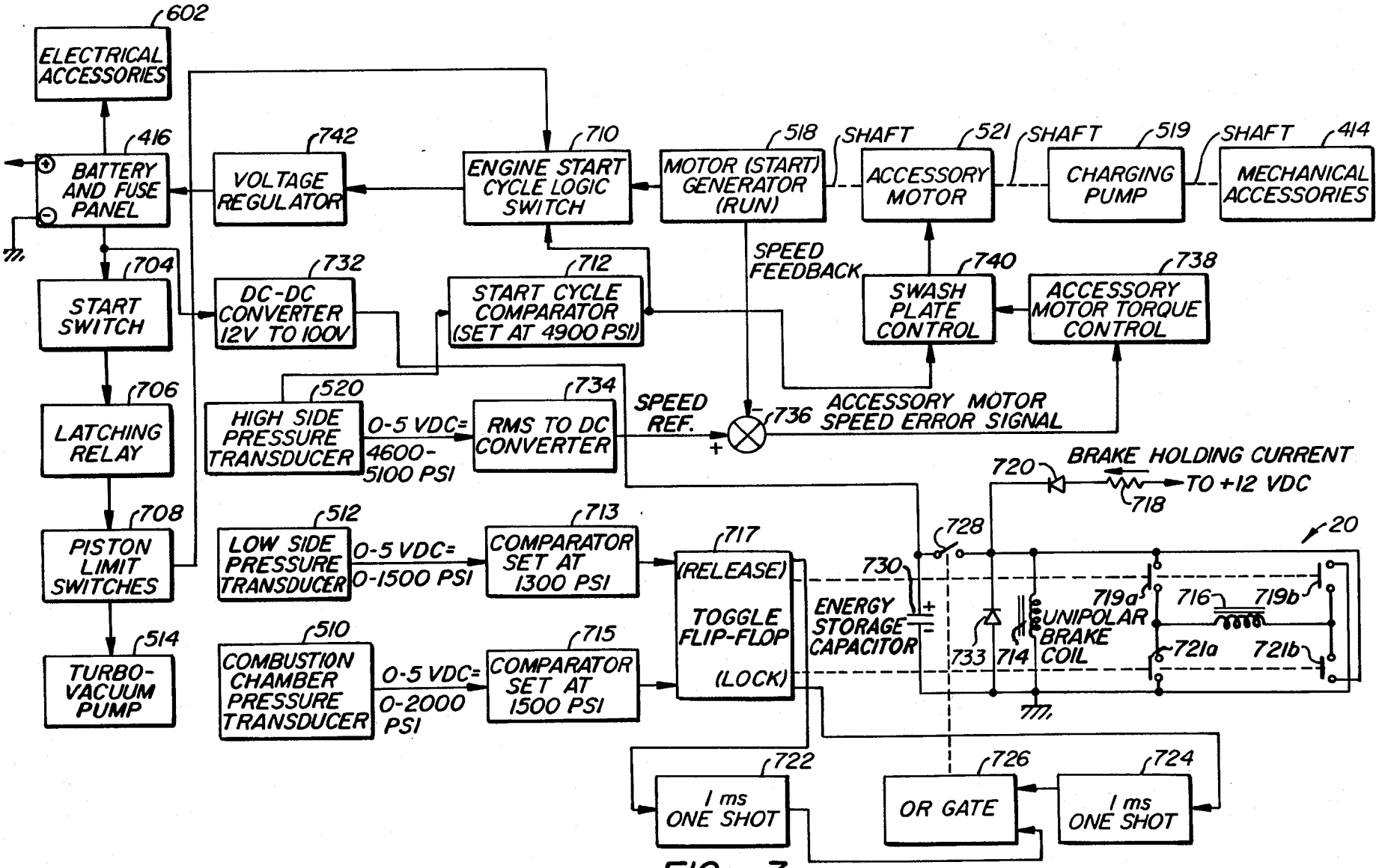
FIG. 7 is a block diagram of the electronic control system of the present invention.

Reference should now be had to FIG. 7 where a block diagram of the electronic control system of the present invention is shown. The system is provided with a conventional storage battery 416 used to supply power to conventional electrical accessories 702, as needed, and a conventional starting switch 704.

Considering first the run cycle for the engine which is dependent upon signals from the low pressure transducer 512 and the combustion chamber pressure transducer 510 each signal being supplied to its respective comparator 713 and 715. Low pressure transducer 512 senses pressure build up in the low pressure accumulators until about 1300 psi is attained, the comparator then supplies a signal to toggle flip-flop 717 to initiate a compression cycle. For the purpose of illustration only, the flip-flop 717 is shown as having an electrical output (solid lines) and mechanical output (dotted lines) for control of the cyclic dwell brake assembly 20. The electrical output supplies current to actuate or release the brake for supplying current to bipolar brake coil 716 in either of two directions dependent upon the closure of switch contacts 719*a* and 719*b* or 721*a* and 721*b*. The mechanical output closes either 719*a* and *b* or 721*a* and *b*; an interlock (not shown) permits only one set of contacts to be closed at any time. The electrical output also actuated the one micro-second one shot signal generators 722 and 724 to energize "or" gate 726 for mechanical closure of a discharge switch 728.

It should be understood that contacts 719*a* and *b*, 721*a* and *b*, and switch 728 are shown as mechanical devices for illustration purposes only. These functions are more dependably and quickly operated with solid state electronic components.

The windings of the brake assembly include coil 714 and coil 716. The relative direction of current flow through these coils determines the condition of the brake, that is, whether the brake is locked or released. The direction of current flow is switched in coil 716 by actuation of the illustrated contacts 719*a* and *b* or 721*a* and *b*. Coil 714 has a constant current through it supplied from a source (battery 416) through current limiting resistor 718 and blocking diode 720. Peaks of energization, as graphically illustrated in FIG. 6 at the beginning of brake lock and brake release, are supplied from a storage capacitor 730 discharged through coils 714 and 716 and discharge switch 728. Capacitor 730 is charged from the storage battery 416 through a voltage converter 732, here shown as converting conventional 12 v d.c. to 100 v d.c. A blocking diode 733 insures that current will not reverse through coil 714.

During the run cycle, comparator 713 causes release of the brake assembly and comparator 715 causes actuation of the brake assembly. During the holding period of both brake lock and brake release, the capacitor 730 is recharged in preparation for the next cycle.

ACCESSORY MOTOR CONTROL—RUN CYCLES

As the high pressure is built up in the high pressure accumulators 500, high pressure transducer 520 supplies a signal to a converter 734 which produces a d.c. signal related to the root-mean-square (RMS) of the high pressure within accumulators 500. That d.c. signal is supplied to a servo control schematically shown at 736. A second input to the servo control 736 is supplied from motor/generator 518 now operating as a generator and supplying a signal related to the speed of the generator. The output signal from servo 736 is supplied as an accessory motor speed error signal to an accessory motor torque control 738 which controls the speed of accessory motor 521 by controlling the swash plate control 740. Accessory motor 521 is a hydraulic motor operated by fluids from the high pressure accumulators 500 and drives motor/generator 518, charging pump 519 and mechanical accessories 414. During the run cycles, pump 519 supplies "make up" fluids from the leakage sumps shown in FIG. 5 at 522. This "make up" increases the RMS pressure in the high pressure accumulators and thus the signal from converter 734 to balance the servo 736 and the signal to the motor control 738. This servo control system insures that the entire system has adequate fluid within the system and prevents the accessory motor from running at an excessive speed.

Considering now the "start" cycle and electronics of FIG. 7, during start operations the turbo vacuum pump 514 has drawn the pistons to full withdrawn position where piston limit switches 708 supply their signal to logic switch 710 to set motor/generator 518 as a motor to drive the charging pump 519. A second signal to the logic switch 710 is supplied from start cycle comparator 712 which performs two functions; firstly, it changes the logic switch to set the motor/generator 518 as a generator when pressure has built up in the high pressure accumulators 520, and, secondly, it controls swash plate control 740 to place the accessory motor 521 in a no-load or free-wheeling condition while the charging pump 519 is being driven by the motor action of motor/generator 518. When a desired pressure has been built up in the high pressure accumulators 500 the comparator 712 returns control of the swash plate control to motor torque control 738. As illustrated in FIG. 6, the desired pressure in high pressure accumulators 500 is attained after a few run cycle operations.

Battery 416 is charged through voltage regulator 742 from the motor/generator 518 when operating as a generator during the run cycles.

BOUNCE SPRING

Figure 1B:
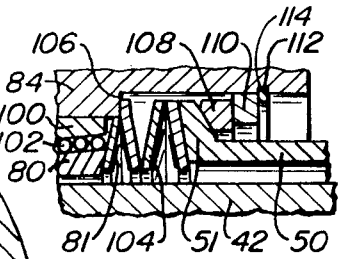
FIG. 1B is a partial sectional view of the portion of FIG. 1 encircled and identified by the label 1B.
Figure 1C:
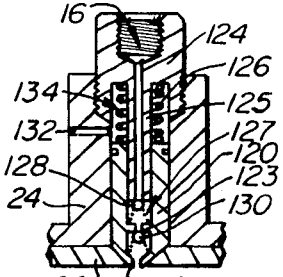
FIG. 1C is a partial sectional view of the fuel injector assembly.

Among the features of the present invention is the location for the bounce springs 104 as a part of the brake assembly 20 and their operation during the compression stroke of the engine. As can be seen in FIG. 1B, the bounce spring has an inside portion that can be contacted by the inside portion of the pump piston 52 as the piston and pushrod are moved in a compression direction (leftward as viewed in FIG. 1). This engagement serves to assure symmetry of the pistons should the pistons drift from centralized position. Synchronism is inherently maintained between the pistons during normal operation. The dwell between cycles assures that both pistons will begin the next compression stroke at the same time. Thus the pistons inherently remain in phase. However, the point of combustion may tend to drift off center as cycling progresses. This is due to the fact that the hydromechanical efficiency of one piston assembly differs slightly from the other. To maintain the piston symmetry within the bounds required for proper port opening, bounce springs are added at the end of the compression stroke. As the pistons drift asymmetrically, one side will begin to engage the corresponding bounce spring set. When this occurs piston kinetic energy is divided between compressing the gas and compressing the bounce spring. The stroke of that particular piston is foreshortened compared to the opposing piston which has not engaged its bounce spring set. This stored energy tends to drive the pistons back toward symmetrical operation.

ACCUMULATOR SIZE

The demand cycling of the engine of the present invention permits the use of substantially smaller accumulators than those used with prior art hydraulic engine systems. High pressure hydraulics are built up as the pump is operated by the engine. The engine only cycles when pressure levels are reduced by demand resulting in an almost immediate rebuilding of the high pressure. The accumulators are sized to handle only the immediate high pressure demands. The accumulator system minimizes the pressure pulses to plus or minus a few percent of average pressure levels. Therefore the fluid motor experiences essentially a constant pressure drop. Since the pressure drop is constant, the torque output must be varied by changing the mechanical advantage of the fluid motor by changing the effective angle of the motor's swash plate. The accelerator petal as would be used in a vehicle incorporating the present engine system either controls directly, or by servo control, the swash plate angle. The combination of accelerator petal position, transaxle gear ratio, and vehicle speed, ultimately dictate the pulse rate of the engine.

FUEL INJECTION

Fuel injection is here illustrated in its simpest form. As shown in place in the cylinder wall 22 and fins 24 against an injector port 122 by an injector fitting 124 and return spring 126. The injector plunger 120 includes as injector nozzle 123. The internal portion of the injector fitting 124 is formed with a hollow inner extension which functions as a piston 125 within the hollow fuel injector plunger 120. A pair of ball check valves 128 and 130 are positioned within the plunger, valve 128 ahead of the piston 125 in injector cavity 127 and valve 130 ahead of the injector nozzle 123, to permit fuel to be drawn into the injector cavity 127 and subsequently forced into the cylinder through nozzle 123. A vent 132 is provided for the spring cavity 134. The plunger 120 is driven outwardly from the cylinder against the return spring 126 during the compression stroke by gas pressure within the cylinder. The piston 125 and check valves 128 and 130 cause fuel to be injected as the plunger moves. With this construction the fuel injection volume remains constant for each engine cycle. Further, the fuel is injected only during compression and not during any portion of the combustion cycle as illustrated in FIG. 6. The fuel mixture is lean, the compression ratio is low (compared to conventional diesel), the time at high temperature is short, and the combustion conditions are constant regardless of load. These factors are all in the right direction to minimize unburnt hydrocarbons, carbon monoxide, and nitrous oxides. Since the mixture is consistently lean at all loads, there will be no smoke.

ADDITIONAL FEATURES

Fuel consumption with the engine described herein is expected to be low for the following reasons. There will be less heat losses because there will be no cylinder head as in a conventional engine and the surface area of the combustion volume is nearly halved, the speed of combustion is constantly high, and the time that the engine is at high temperature of combustion is shortened because the engine operates on an Otto cycle rather than the less efficient diesel cycle.

Weight of the vehicle with the present engine and drive system installed will be substantially less than conventional spark ignition or diesel engine systems. It is predicted that a 90 horsepower engine and its drive system including the heat exchangers, the accumulators, the fluid motor, and the accessories with miscellaneous electronics and fittings will weigh less than 250 pounds.

Acceleration of a vehicle with the present engine as its drive system will be very high because of the hydraulic system employed for drive. The hydraulic drive is substantially incompressable and the accumulator system will have full high pressure available at all times. The drive to the wheels of a vehicle will therefore be almost instanteous on demand, regardless of vehicle speed. Further, the inertial mass of the system is considerably less than a conventional crank engine.

There will be a reduction in pollution with use of the present engine because the engine will operate at a relatively low compression compared to conventional diesel engines, and the engine will have constant and favorable combustion conditions tending to burn all hydrocarbons and to eliminate smoke.

Lubrication of the interior of the engine cylinder and the brake mechanism is accomplished by leakage of hydraulic fluid and blowby of engine gasses. The leakage fluid squirts through to the internals of the brake mechanism and the cylinder walls to cool and lubricate the brake and pushrod. After combustion the blowby pressure establishes a pressure in the portion of the engine cylinder where the brake and exhaust port are located to force the leakage fuel out to the sump for return to the hydraulic system. Check valves control the movement of the fluids into and out of the exhaust port. Gasses will be separated from the returned fluid before the fluid is added to the hydraulic system.

While a certain preferred embodiment of the invention has been specifically disclosed, it should be understood that the invention is not limited thereto as many variations will be readily apparent to those skilled in the art and the invention is to be given its broadest possible interpretation within the terms of the following claims.

I claim:

1. A free piston internal combustion cyclic power mechanism including releasable restraining means within said mechanism to provide a variable dwell between each cycle of said free piston within said mechanism, storage means for storing the energy produced by each given cycle of said free piston mechanism, said mechanism further including means operable on said releasable restraining means for terminating (a) said variable dwell of said free piston within said mechanism and to initiating a cycle of said free piston within said mechanism when a preestablished portion of said energy stored in said storage means has been consumed.

2. In a free piston engine having a cylinder, a piston reciprocably moveable within said cylinder, and a brake means operable to restrain said piston in a desired position within said cylinder, said brake means comprising:

a collet means adapted to engage a means operated with said piston, said collet comprising a pair of members having cooperating inclined surfaces separated by moveable roller pins, one of said members being laterally biased in one direction with respect to the other of said members whereby lateral movement of said one member due to said bias is translated into radial movement through cooperation of said inclined surfaces and roller pins to force said collet into engagement with said means operated with said piston to restrain said piston in said desired position, and means for moving said one member in a direction opposite to said bias to cause release of said collet from engagement with said means operated with said piston to release said restraint on said piston and to permit reciprocable movement of said piston within said cylinder.

3. A free piston hydraulic pump unit, comprising in combination, a free piston combustion engine and a hydraulic pump, the output energy of combustion of said engine providing the input to said pump, said engine including:

an engine cylinder, an engine piston reciprocable in the engine cylinder, said pump including:

a pump cylinder, a pump piston reciprocable in said pump cylinder, means interconnecting the engine and pump pistons for related dependent movements, releasable restraining means mounted within said engine cylinder operable on said interconnecting means for releasably restraining said interconnecting means when said energy of combustion has been extracted from said engine piston, said releasable restraining means being actuated in response to combustion for setting said restraining means for restraining said interconnecting means, and means actuated in response to consumption of energy from said pump unit for releasing said restraining means to permit said pump piston to be driven to said compression position.

4. The pump unit of claim 3 with the addition of a valving means for supplying pressurized hydraulic fluid to said pump piston to drive said engine piston to a compression position within said engine cylinder, said valving means including means for extracting high pressure hydraulic fluid from said pump unit when said engine piston drives said pump piston within said pump cylinder in response to combustion in said engine cylinder.

5. A free piston engine comprising:

an engine cylinder, at least one engine piston means reciprocally mounted in said engine cylinder, means for moving said engine piston means within said cylinder to establish conditions of compression and combustion within said engine cylinder to impart kinetic energy to said engine piston means in a combustion expansion stroke, said means including means for extracting said kinetic energy from said engine piston means during said expansion stroke, means mounted within said cylinder for releasably restraining said engine piston means within said engine cylinder after said engine piston has completed said expansion stroke and reversed its direction of reciprocal motion in response to extraction of said energy from said engine piston means, said releasable restraining means being operable to restrain said engine piston upon completion of said expansion stroke when said kinetic energy of combustion has been extracted and being operable to restrain said engine piston upon the occurrance of said reversal of direction of reciprocal motion, and means for releasing said releasable restraining means in response to consumption of at least a predetermined portion of said extracted energy.

6. The engine of claim 5 with the addition of a pressure operated fuel injector means operated during movement of said piston means to establish said condition of compression.

7. The engine of claim 5 wherein said means for releasably restraining said engine piston means is a solenoid operated brake means operable on means connected to said piston means, said brake means being operable to restrain said piston means in a position in preparation for compression movement, and said brake means being releasable to permit said compression movement.

8. The engine of claim 7 wherein said solenoid operated brake means includes means actuated in response to combustion in said cylinder, said actuated means causing said brake means to restrain said means connected to said piston when said piston has travelled to its position in said cylinder where said kinetic energy imparted to said engine piston means has been extracted by said energy extraction means.

9. The engine of claim 5 wherein said means for moving said engine piston means is a hydraulic system operable for moving said piston for compression and combustion, and said means for extracting energy from said piston means is a hydraulic pump.

10. The engine of claim 9 wherein said hydraulic pump means extracts energy from said piston means by supplying pumped hydraulic fluid to an accumulator system and wherein said accumulator system includes means for controlling said releasable restraining means to release said restraining means when energy is withdrawn from said accumulator system.

11. The engine of claim 5 having a pair of opposed engine pistons within said engine cylinder.

12. The engine of claim 11 wherein said means for releasably restraining said engine piston means is a mechanical brake means operable on means connected to said piston means, said brake means including a bounce spring centralizing means operable with a portion of said means connected to said piston means to centralize said piston means during movement of said pistons toward each other to establish said condition of compression.

13. The engine of claim 11 with the addition of centralizing means for centralizing said engine piston means within said cylinder, said centralizing means being operable on said pistons during movement of said pistons toward each other to establish said condition of compression.

14. The engine of claim 13 wherein said centralizing means is a bounce spring cooperating with said engine piston means during compression movement.

* * * * *